US007726550B2

(12) United States Patent
Wilen

(10) Patent No.: US 7,726,550 B2
(45) Date of Patent: Jun. 1, 2010

(54) INSERT WITH A RETURN MAILER

(75) Inventor: Richard Wilen, Deerfield Beach, FL (US)

(73) Assignee: Wilen Press, LC, Deerfield Beach, FL (US)

( * ) Notice: Subject to any disclaimer, the term of this patent is extended or adjusted under 35 U.S.C. 154(b) by 1282 days.

(21) Appl. No.: 10/832,507

(22) Filed: Apr. 26, 2004

(65) Prior Publication Data

US 2005/0236467 A1 Oct. 27, 2005

(51) Int. Cl.
*B65D 27/06* (2006.01)

(52) U.S. Cl. ..... 229/301; 229/303; 229/304; 229/305; 229/307; 229/72

(58) Field of Classification Search ..... 229/301, 229/303, 304, 305, 307, 70, 72
See application file for complete search history.

(56) References Cited

U.S. PATENT DOCUMENTS

| | | | | | |
|---|---|---|---|---|---|
| 691,767 | A * | 1/1902 | Herndon | ..... | 229/72 |
| 877,060 | A * | 1/1908 | Douglass | ..... | 229/72 |
| 2,016,063 | A | 10/1935 | White | | |
| 2,062,776 | A * | 12/1936 | Berkowitz | ..... | 229/80 |
| 3,718,277 | A * | 2/1973 | Volkert | ..... | 229/301 |
| 3,858,792 | A * | 1/1975 | Volkert | ..... | 229/301 |
| 3,905,545 | A | 9/1975 | Juszak et al. | | |
| 4,435,001 | A * | 3/1984 | Mills et al. | ..... | 229/69 |
| 4,775,095 | A * | 10/1988 | Emmott | ..... | 229/303 |
| 4,960,237 | A | 10/1990 | Bendel | | |
| 5,064,115 | A * | 11/1991 | Steidinger | ..... | 229/304 |
| 5,429,298 | A | 7/1995 | Chess | | |
| 5,487,566 | A | 1/1996 | Hedge | | |
| 6,019,280 | A | 2/2000 | Peterson | | |
| 6,435,404 | B1 * | 8/2002 | Feick | ..... | 229/303 |
| 2002/0030093 | A1 * | 3/2002 | Kim | ..... | 229/302 |

* cited by examiner

*Primary Examiner*—Nathan J Newhouse
*Assistant Examiner*—Jack H Morgan, Jr.
(74) *Attorney, Agent, or Firm*—James David Johnson, PA; James David Johnson

(57) ABSTRACT

A mailer is disclosed for distributing advertisements and invoices. The mailer provides an envelope for returning the invoices and a buck slip for displaying advertisements and incentives. The return mailer is attached to the mailer and removed from the mailer simultaneously upon the opening of the mailer.

8 Claims, 5 Drawing Sheets

INSERT WITH A RETURN MAILER

FIELD

The invention relates to a mailer assembly. More particularly, this invention relates to a mailer assembly for direct mail and/or promotional applications.

BACKGROUND

Known mailer assemblies for direct mail applications have been constructed in various ways to provide a medium for disseminating information, advertisements and invoices. In many cases, a direct mail mailer assembly is provided with a tear-off portion which is to be removed by a recipient. The tear-off portion may be in the form of a return mailer, an order form for purchasing magazines or merchandise, an invoice for goods or services rendered, or a form for returning needed information to the sender.

One example of a known mailer having a return mailer is U.S. Pat. No. 2,016,063 to E. T. White. White discloses an envelope consisting of a single sheet of paper divided into four leafs. The front page on the first leaf contains a window for displaying a mailing address, and the front page on the fourth leaf contains the corresponding mailing address. To display the mailing address, the leafs are folded upon each other so that the front page of the fourth leaf is beneath the front page of the first leaf.

White includes a return mailer that is connected within the mailing envelope. To retrieve the return mailer, the mailer envelope must first be opened and the return mailer must then be torn off the mailer envelope.

The return address is found on the rear page of the forth leaf. To address the return mailer, the forth leaf must first be torn off of the third leaf, and the forth leaf must then be attached to the mailer envelope with the address displayed on the rear page of the forth leaf.

The extra steps, of removing the return mailer, removing the page having the return address, and combining the two, will likely dissuade a recipient from mailing the return mailer. Accordingly, White fails to teach a return mailer that is pre-assembled for the user the that detaches from the mailer upon the opening of the mailer.

Another prior art envelope is U.S. Pat. No. 6,019,280 to Peterson. Peterson discloses a tri-fold mailer. The mailer has a return postcard that is integral to the second or third leaf of the mailer. To remove the return postcard, the envelope must first be opened and the return postcard must then be torn from the mailer. This aspect of Peterson is problematic because it requires the recipient to take further steps to remove the return postcard. Accordingly, Peterson fails to teach a mailer having a return mailer that is automatically detached from the mailer upon the opening of the mailer.

Peterson also teaches advertising buck slips, where the buck slips are loosely placed within the mailer prior to mailing to the recipient. The leafs are placed within the center of the mailer and the mailer is sealed about all four edges to secure the advertisements. If any of the sides of the mailer open in transit, then the advertisements would fall out. Further, sealing each edge of the mailer requires more glue than only sealing, for example, the top edge of the mailer with glue, and creating a seal on the bottom edge by folding the mailer leafs.

Peterson fails to teach a mailer having buck slip advertisements that are permanently attached to the mailer. With the advertisements secured to the mailer, the sides of the mailer would not need sealing.

Another mailer with a return mailer is disclosed in U.S. Pat. No. 4,960,237 to Bendel. Bendel discloses a multiply outgoing mailer, where each sheet is the same size as each other sheet and each sheet is adhered to each consecutive sheet. In Bendel, the return mailer is retrieved from the mailer by opening the mailer and tearing the sheet or sheets with the return mailer from the remainder of the mailer. The sheets that comprise the return mailer are then folded about fold lines to create the form of the return mailer.

The problem with Bendel is that the user is required to take a series of steps before the return mailer can be used, including opening the envelope, separating the return mailer from the mailer, and forming the return mailer from the separated sheet. These steps would discourage the user from utilizing the return mailer. Accordingly, Bendel fails to teach a return mailer chat is formed prior to reaching the recipient and removed from the mailer upon the opening of the mailer.

SUMMARY

A mailer is disclosed for distributing advertisements and invoices. The mailer provides an envelope for returning the invoices and a buck slip for displaying advertisements and incentives. The return mailer is removed from the mailer simultaneously upon the opening of the mailer.

BRIEF DESCRIPTION OF THE FIGURES

In order that the manner in which the above recited objectives are realized, a particular description of the invention will be rendered by reference to specific embodiments thereof that are illustrated in the appended drawings. Understanding that the drawings depict only typical embodiments of the invention and are not therefore to be considered to be limiting of its scope, the invention will be described and explained with additional specificity and detail through the use of the accompanying drawings in which.

and

Figure 5:
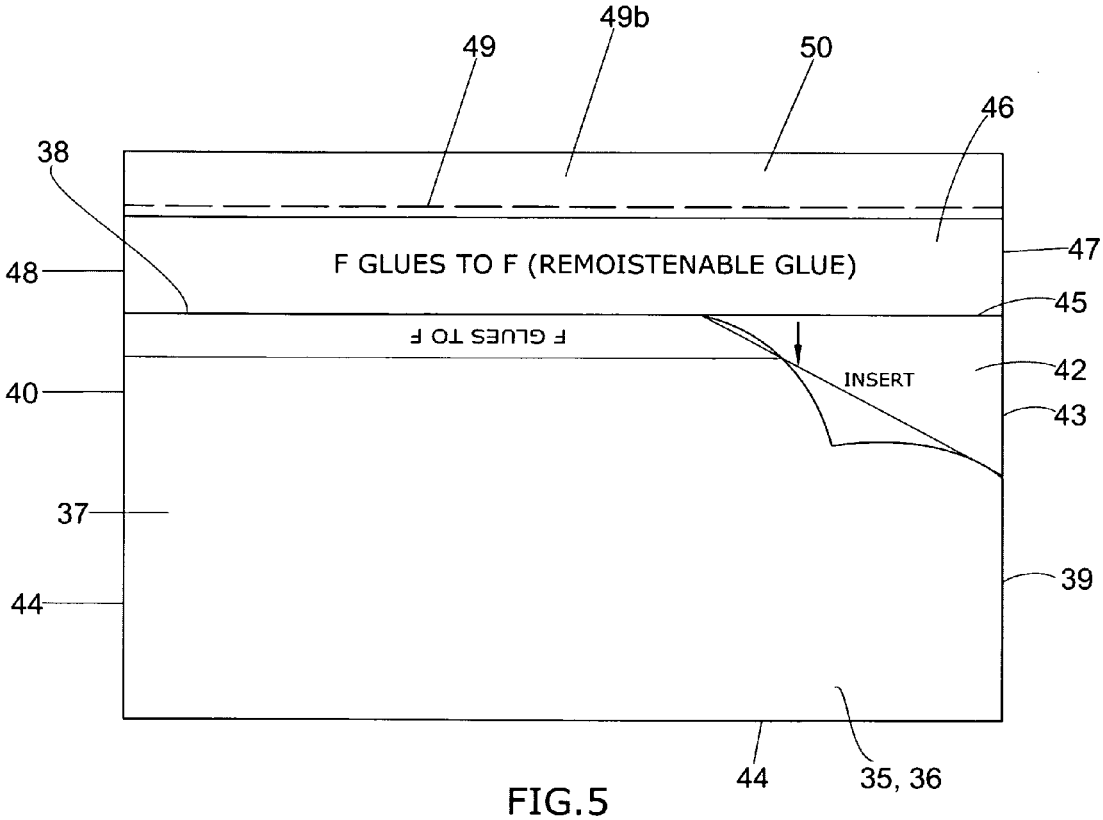

FIG. 5 is a front view of a return mailer.

DESCRIPTION OF THE EMBODIMENTS

A matter is disclosed (FIG. 1) for distributing advertisements and invoices. The matter provides a mailer or envelope 35 for returning the invoices (FIG. 5) and a buck slip 51 (FIG. 6) for displaying advertisements and incentives. The return mailer 35 is removed from the matter 1 simultaneously upon the opening of the mailer 1.

Figure 3:
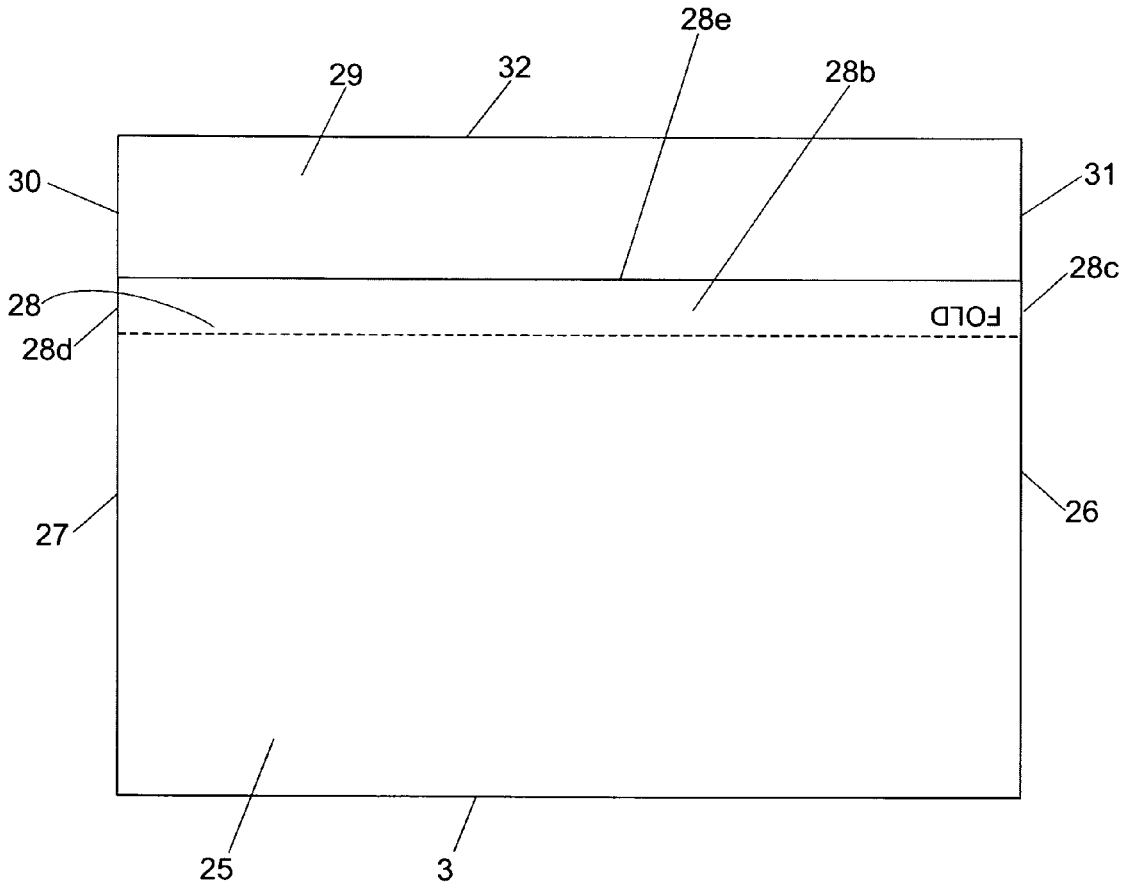
FIG. 3 is a rear view of a rear leaf of the mailer.

More specifically, the mailer 1 has a front face 2 (FIG. 1) and a rear face 25 (FIG. 3). The front face 1 and the rear face 25 (FIG. 1) are a continuous sheet folded at a bottom edge 3. The mailer 1 (FIG. 1) has first and second side edges 4, and 6 which are not sealed.

Figure 1:
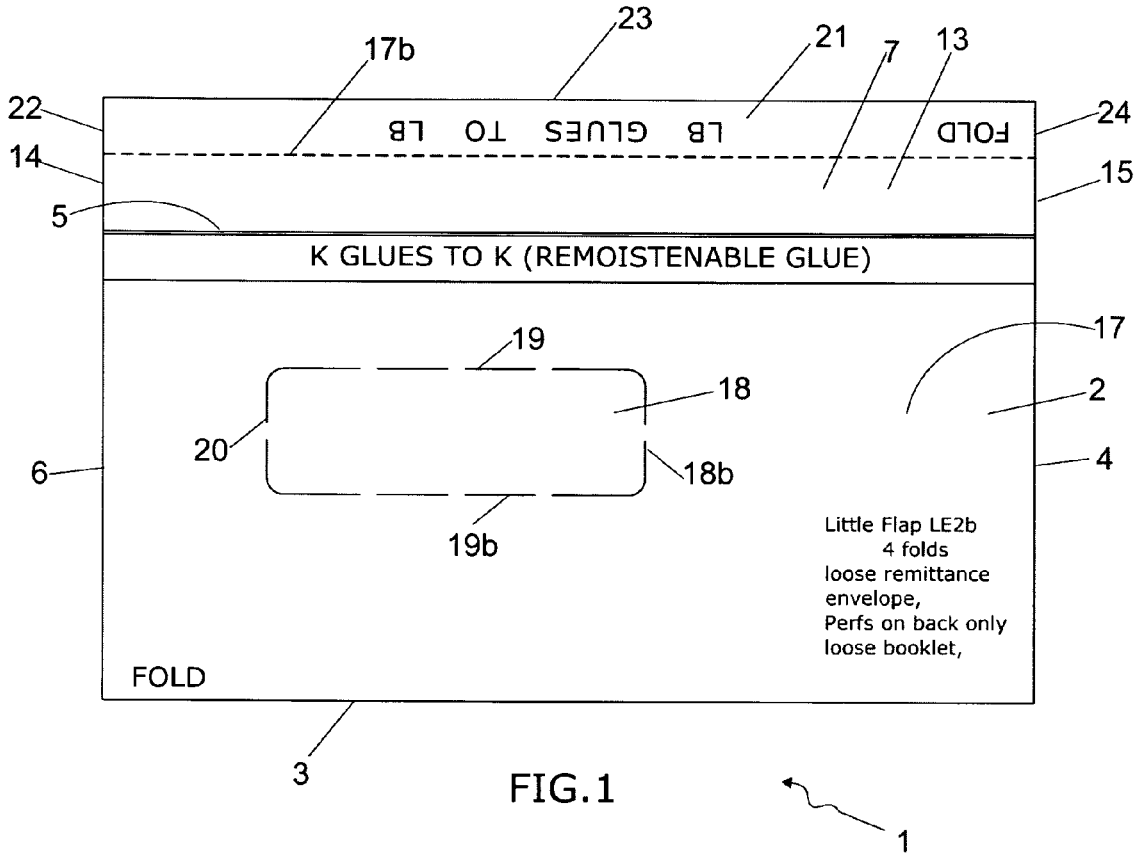
FIG. 1 is a front view of a front leaf and pocket of a mailer.

The front face 2 has a tear off section 21 connected to the remainder of the front face 2 and mailer 1 via perforated lines 17*b* (FIG. 1). The return mailer 35 (FIG. 5) has a tear off section 49*b* that is attached to the tear off section of the front face 2. Upon removing the tear off section of the front face 21, the front 2 and rear 25 faces of the mailer 1 are opened, and the return mailer 35 is released from the mailer 1.

Turning now to FIG. 1, the mailer 1 is disclosed having a front leaf 2. The front leaf 2 is made of paper having a weight that enables the front leaf 2 to withstand commonly applied stress during the processing and mailing of the mailer 1. The weight of the front leaf 2 also allows the mailer 1 to maintain a first class mail rating when the mailer is filled with a return mailer 35 and a buck slip 51.

The front leaf 2 forms the front face of a front pocket 17. The pocket 17 is used, for example, for mailing invoices to recipients. On the bottom of the pocket 17 is bottom edge 3. The bottom edge 3 is continuous with the pocket 17 and is shaped to fit against an adjacent edge of a return mailer and a buck slip stored with in the mailer 1. For example, the bottom edge 3 is straight and has a length of about seven and a quarter inches.

Opposing the bottom edge 3, on the pocket 17, is a top edge 5. The top edge 5 forms the top lip of the pocket 17. The shape of the top edge 5 is designed to accommodate a rectangular invoice having a long dimension being equal to or less than the dimension of the bottom edge 3. The top edge 5 is parallel to the bottom edge 3, the edge 5 is straight and has a length of about seven and a quarter inches.

On the side of the pocket 17 is first and second side edges 4 and 6. The first and second side edges 4 and 6 are both shaped to fit against an adjacent edge of a return mailer 35 and a buck slip 51 stored within the mailer 1. For example, the first and second side edges 4 and 6 are parallel to each other, both are straight, and both are perpendicular to the bottom edge 3 and top edge 5.

The pocket 17 has a window 18. The purpose of the window 18 is to display-a forwarding address on the front face of an invoice placed within the pocket 17. The window 18 has top and bottom edges 19 and 19*b*. The edges 19 and 19*b* are long enough to display the length of a normal address label. For example, edges 19 and 19*b* are each about three inches long. The bottom edge 19 is spaced from the bottom edge of the pocket 3 by a distance that allows the display of a normal mailing label. For example, the lower bottom edge 19 is an inch and a half from the bottom edge of the front face 3.

The window 18 has first and second side edges 18*b* and 20. The edges 18 and 20 are long enough to display the height of a normal address label. For example, edges 18*b* and 20 are each one inch tall. The side edge 20 is spaced from the side edge of the pocket 6 by a distance that allows the display of a normal mailing label. For example, the side edge 20 is an inch and a quarter from the side of the pocket 6.

As illustrated, the corners of the window 18 are chamfered. The radius of the chamfer is small enough so that the text in the label is not obscured. For example, the chamfer radius is one quarter of an inch. However, it is considered that the corners could be squared.

Figure 2:
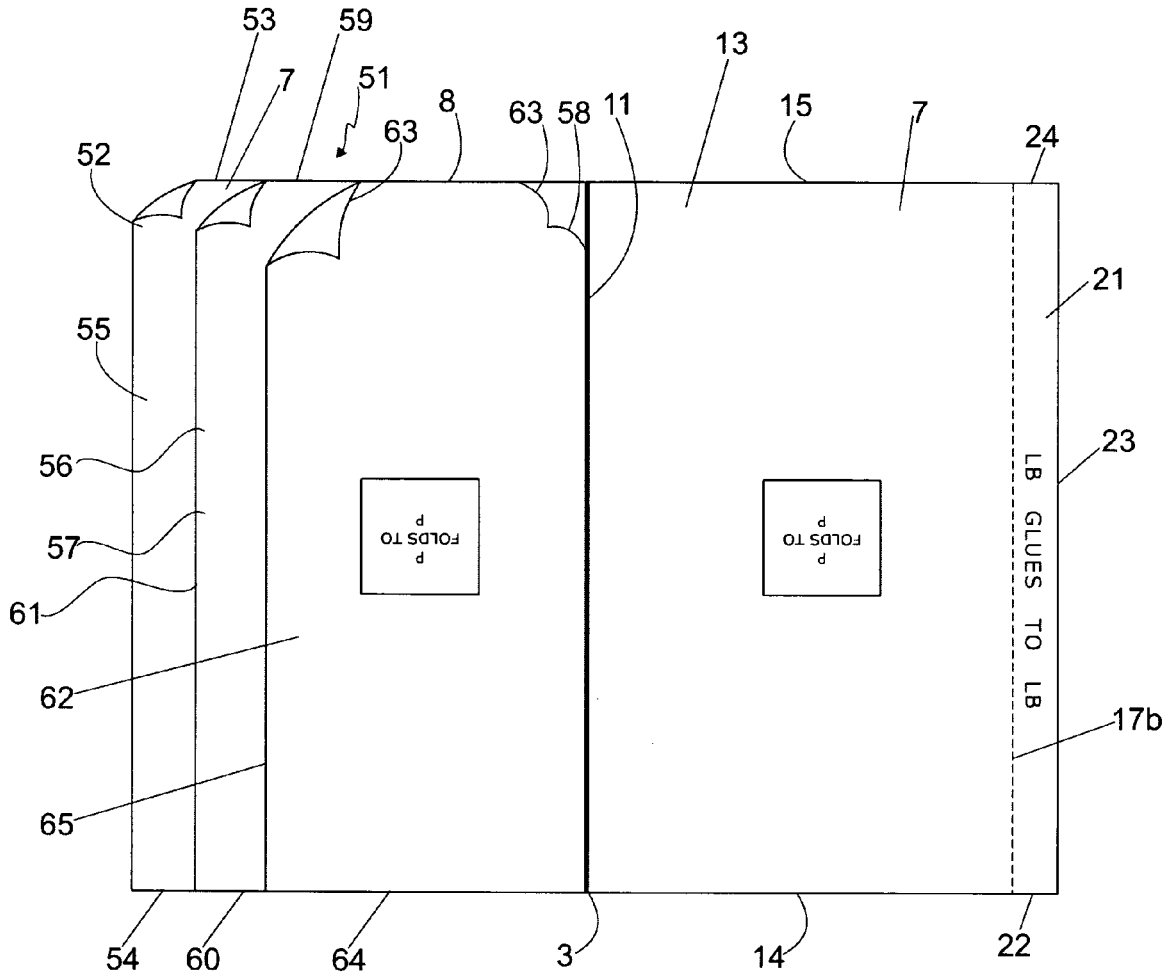
FIG. 2 is a rear view of an leaf of the mailer, exposing a front view of the buck slips of the mailer.

Referring to FIGS. 1 and 2, the mailer 1 has a first inner leaf 7 that is adjacent to the front leaf 2. The inner leaf 7 is used to form the back face of the pocket 17, extending from the edge 3 of the front leaf 2 by a dimension that is at least as great as the respective dimension of a return mailer or buck slip stored withing the mailer 1.

The inner leaf 7 is made of paper having a weight that enables the paper to withstand commonly applied stress during the processing and mailing of the mailer 1. The weight of the inner leaf 7 also allows the mailer 1 to maintain a first class mail rating when the mailer is filled with a return mailer and a plurality of buck slips.

Referring to FIGS. 1 and 2, the inner leaf 7 has a middle segment 13. The middle segment 13 has parallel first and second side edges 14 and 15. The side edges 14 and 15 are co-linear to the first and second edges 6 and 4, respectively, of the pocket 17. The first and second side edges 14 and 15 are each at least as long as an adjacent edge of a return mailer or buck slip stored with the mailer 1. The edges 14 and 15 are shorter than top and bottom edges 11 and 17*b*. The proportionality between the lengths of edges 14 and 15 and edges 11 and 17*b* is equivalent to the proportionality of the edges of a standard rectangular mailer. For example, the first and second side edges 14 and 15 are both about four inches long.

The middle segment has a top edge 17*b*. The top edge 17*b* and bottom edge 11 are designed to fit against opposing edges of a return mailer or buck slip stored withing the mailer 1. For example, the top edge 17*b* is parallel to the bottom edge 11 and the same length as the top edge 11 of the bottom segment. Accordingly, the edges 11, 13, 15 and 17*b* of the middle segment form a rectangular surface for holding a rectangular return mailer or buck slip within the mailer 1.

In use, the inner leaf 7 against the pocket 17, the top edge 5 of the pocket 17. Specifically, the middle segment 13 is sealed against the return leaf 25 so that the bottom edge 11 is sealed against the bottom edge 3 using, for example, staples. The first and second sides of the inner leaf 14 and 15 are sealed against the first and second side edges 4 and 6 of the pocket 17 using, for example, glue. The thickness of the glue on the first and second sides 14, and 16 is enough to secure the inner leaf 7 against the pocket 17. For example, the thickness is one quarter of an inch.

Upon sealing the inner leaf 7 against the pocket 17, the top edge 5 of the pocket 17 remains unsealed. The opening between the two faces defines the enclosure for the pocket 17 for inserting papers such as letters, invoices, promotions, etc.

Referring to FIGS. 1 and 2, the inner leaf 7 has a tear away segment 21. The tear segment 21 is capable of receiving glue and being pressed against the mailer 1 for sealing the segment 21 against the mailer 1. The tear away segment 21 is capable of being torn away by the recipient for opening the mailer 1.

The top segment 21 and middle segment 13 are connected by a perforated line. The perforated line is the top edge of the middle segment 17*b*. The perforations are designed to enable a recipient to tear away the segment 21 without tearing the remainder of the inner leaf 7. The perforations are also designed to handle the stress of normal mailing without tearing.

The top segment 21 has first and second side edges 22 and 24. The first and second side edges 22 and 24 each extend linearly, the same distance, from the first and second side edges 14 and 15 of the middle segment 13, away from the edge 11 of the middle segment 13. The distance that first and second side edges 22 and 24 extend provides a surface area for applying sealant to secure the inner leaf 7 against the mailer 1. For example, the length of the first and second side edges 22 and 24 are both a quarter of an inch.

Adjacent to and perpendicular with the first and second side edges 22 and 24 is top edge 23. The top edge spans the length of the inner leaf 7 and is, for example, about sever and a quarter inches long. The top edge 23 completes the rectangular surface of the top segment 21, enabling the top segment 21 to receive the sealant and seal the inner leaf 7 within the closed mailer 1.

Turning to FIG. 3, the mailer 1 has a rear leaf 25. The rear leaf 25 is continuous with the bottom edge 3 of the pocket 17. The rear leaf 25 has first and second side edges 26 and 27. The first and second side edges 26 and 27 are shaped to fit against the adjacent edge of the return mailer or buck slip. Accordingly, the first and second side edges 26 and 27 are adjacent to and co-linear with the first and second side edges of the inner leaf 15 and 14.

Complementing both the first and second edges 26, and 27, and opposing the bottom edge 3, is the top edge 28 of the rear leaf 25. The top edge 28 is shaped to fit against the adjacent edge of the return mailer. The top edge 28 is adjacent to and co-linear with the top edge of the inner leaf 17*b*. The top edge 28 is parallel with the bottom edge 3 and perpendicular to the first and second side edges 26 and 27 of the rear leaf 25.

According to the illustration, the rear leaf 25 is a rectangle, having the same dimensions as the middle segment of the inner leaf 13. The rear leaf has a surface area that is at least as large as a return mailer stored within the mailer 1.

The rear leaf 25 has a tear away segment 28*b*. The tear segment 28*b* is capable of receiving glue and being pressed against the tear away segment 21 of the inner leaf 7 for sealing the mailer 1. The tear away segment 28*b* is capable of being torn away by the recipient for separating the inner leaf 7 and rear leaf 25 so as to open the mailer 1.

The tear away segment 28*b* and rear leaf 25 are connected by a perforated line. The perforated line is the top edge of the rear leaf 28. The perforations are designed to enable a recipient to tear away the segments 28*b* and 21 concurrently without tearing the remainder of the inner leaf 7 or the rear leaf 25. The perforations are also designed to handle the stress of normal mailing without tearing.

The tear away segment 28*b* has first and second side edges 28*c* and 28*d*. The first and second side edges 28*c* and 28*d* each extend linearly, the same distance, from the first and second side edges 26 and 27 of the rear leaf 25, away from the bottom edge 3. The distance that first and second side edges 28*c* and 28*d* extend is the same distance that edges 22 and 24 extend from the top edge 17*b* of the inner leaf. The surface created from the edges 28*c* and 28*d* provides a surface area for applying sealant to secure the rear leaf 25 against the inner leaf 7 of the mailer 1.

Adjacent to and perpendicular with the first and second side edges 28*c* and 28*d* is top edge 28*e*. The top edge spans the length of the top edge 23 of the tear off section 21 of the inner leaf 7. The top edge 28*e* completes the rectangular surface of the top segment 28*b*, enabling the top segment 28*b* to receive the sealant and seal against the top segment 21 of the inner leaf 7 to close the mailer 1.

Figure 4:
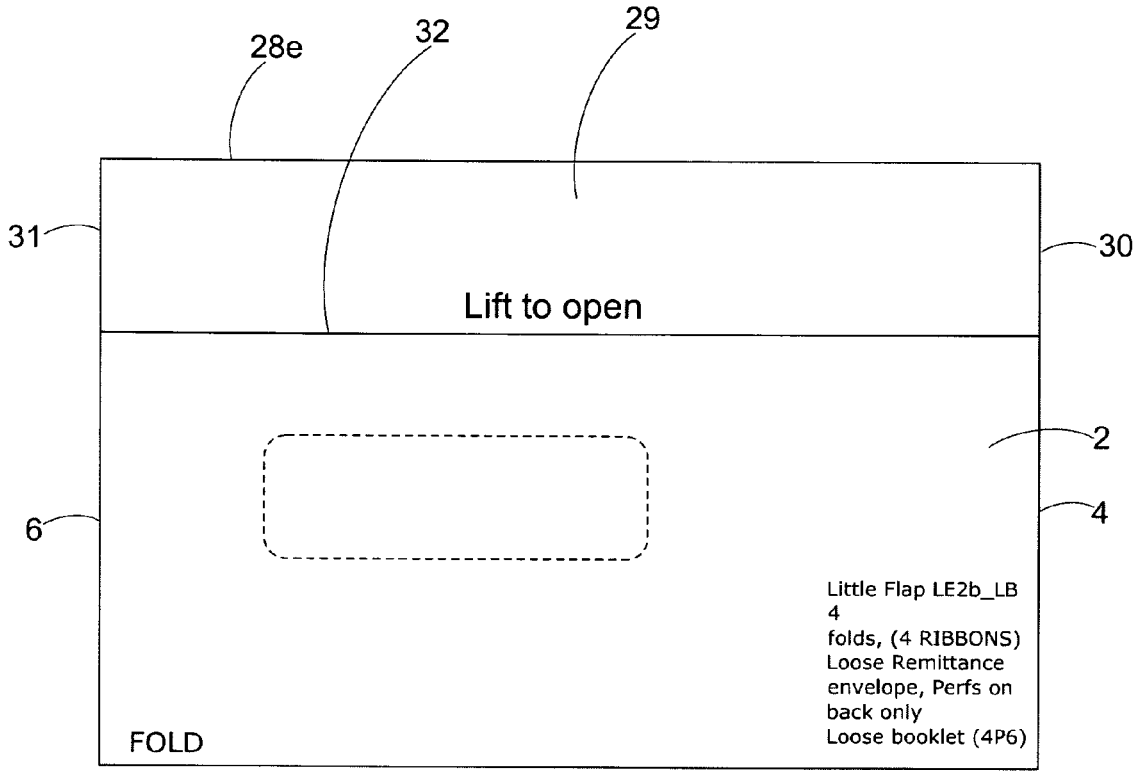
FIG. 4 is a front view of the front leaf and pocket and lid of the mailer with the lid sealed against the pocket.

Turning now to FIGS. 3 and 4, the mailer has a third leaf 29. The third leaf forms 29 an opening flap for the mailer 1. The purpose of the opening flap 29 is to allow the user to open the mailer 1 in two steps. The first step is to peel off a sealant on the flap to expose the free edge 5 of the pocket 17 (FIG. 1). The second step is to tear the tear off sections 21 and 28*b* from the inner and rear leafs 7 and 25, from the mailer 1 thereby opening the mailer 1.

The opening flap 29 shares the top edge 28*e* with the rear leaf 25. Accordingly, the opening flap 29 is continuous with and comprises the same material as the rear leaf 25 and the pocket 17.

The opening flap 29 has parallel first and second side edges 30 and 31. The first and second side edges 30 and 31 are collinear with the first and second side edges 26, and 27 of the rear leaf 25. Upon placement of the lid 29 against the pocket 17, the first and second side edges 30 and 31 are collinear with the first and second side edges of the pocket 4 and 6.

Upon placement of the lid 29 against the pocket 17, the first and second side edges 30 and 31 extend downwardly so as to cover the opening edge 5 of the pocket 17. The first and second edge 30 and 31 extends past the opening of the pocket 17 to the extent that an applied sealant will prevent the flap 29 from opening in transit. As an illustration, the first and second side edges 30 and 31 extend one quarter of an inch past the top edge of the front leaf 5.

Between the first and second side edges 30 and 31 is a bottom edge 32 of the opening flap 29. The bottom edge is linear, perpendicular to the first and second edges 30 and 31, and parallel to the top edge 28*e*. The length and shape of the bottom edge 32 is the same as the top edge 28*e* to provide the opening flap 29 with a rectangular surface area.

Referring to FIG. 5, the top segment of the inner leaf 21 is sealed to the inner surface of the opening flap 29. Upon the pealing of opening flap 29 from the pocket 5, the inner leaf 7 remains sealed to the opening flap 29. It is not until the opening flap 29 is torn from the mailer 1 that the top segment of the inner leaf 7 becomes detached from the mailer so that the mailer can be opened.

The flap has no perforations. Accordingly, the flap is capable of being opened without tearing the tear off sections 21 and 28*b* from the mailer. This allows the recipient to open the pocket 17 and review the contents of the pocket without immediately having to review the buck slip or handle the return mailer within the mailer 1. This is appropriate because the contents of the pocket 17 are often very important compared to the contents of the buck slip and consist of, for example, a bill. Once the recipient has reviewed the contents of the pocket 17, the recipient can tear off the sections 21 and 28*b* from the mailer 1 to separate the inner leaf 7 from the rear leaf 25 and open the mailer.

Turning now to FIG. 5, a return mailer 35 is disclosed. The return mailer 35 has a pocket 36 that is capable of receiving the invoice that was included in the front pocket 17. The return mailer 35 is made of paper having a weight that enables the paper to withstand commonly applied stress during the processing and mailing of the mailer 1. The return mailer 35 comprises a material that also allows the mailer 1 to be maintain a first class mail status upon being sent to the recipient.

The return mailer has a front leaf 37. The front leaf 37 has a top edge 38. The to edge 38 forms the top edge of the pocket 36. The top edge 38 is dimensioned to fit a standard invoice. For example, the top edge is about seven and a quarter inches long.

The front leaf 37 also has first and second side edges 39 and 40. The first and second side edges 39 and 40 are parallel to each other and perpendicular to the top edge 38. The length of each side edge 39 and 40 enables an invoice or buck slip to be placed within the pocket 36 without being folded or crushed. For example, each side edge 39 and 40 is about three and a half inches long.

The pocket 36 has a lower edge 41. The lower edge is parallel to the upper edge 38 and perpendicular to both side edges 39 and 40. The length of the lower edge is the same as the length of the upper edge 38. The shape of the lower edge 41 allows the edge 41 to abut an invoice or buck slip placed inside the return mailer 35.

The shape of the front leaf of the pocket 36, as a result of the first and second side edges, 39 and 40, and the top and bottom edges 38 and 41, is rectangular. The rectangular shape is appropriate because average buck slips and invoices are printed on rectangular sheets or folded in rectangular sections.

The pocket 36 has a rear leaf 42. The rear leaf shares the lower edge 41 with the front leaf 37, so that the rear leaf 42 and the front leaf 37 are a continuous sheet of material. Forming the front and rear leafs from a single sheet of material enables the bottom edge of the pocket to be sealed by folding the sheet about the edge 41, without the need of a sealant.

The rear leaf 42 has first and second side edges 43 and 44. The first and second side edges 43 and 44 are parallel to each other, collinear with, and the same size as the first and second side edges 39 and 40 of the pocket 36.

The first and second edges 39 and 40 of the front leaf 37 are sealed against the first and second edges 43 and 44 of the rear leaf 43. The sealant is a common adhesive, such as a press on adhesive or an adhesive that is activated via heat treatment. The sealant is applied along the entire length of edges 39, 40, 43 and 44, and projects inwardly on the front and rear leafs 37 and 42 to a distance that provides a permanent seal. For example, the sealant projects one half of an inch from the outside of the pocket 36 towards the center of the pocket 36.

The rear leaf 42 has a top edge 45. The top edge 45 is parallel to the bottom edge 41 and the same length as the bottom edge. The edge 45 is also perpendicular to the side edges 43 and 44. The side edges 43 and 44, and opposing top and bottom edges 45, and 41 of the rear leaf provide the rear leaf with the same rectangular size and shape as the front leaf of the pocket 35.

It is to be appreciated that the dimensions of the pocket can be scaled to accommodate different sized buck slips or invoices, so long as the coincident edges on each face have the same dimensions and directions.

Extending from the top edge 45 of the rear leaf 42 is a lid 46 that is capable of folding against the front leaf 37 of the pocket 36 for sealing the return mailer 35. The lid 46 has first and second parallel side edges 47 and 48. The side edges 47 and 48 extend linearly from the edges 43 and 44 of the rear leaf 42 of the pocket 36.

The first and second side edges 47 and 48 are dimensioned to be long enough to provide the lid 46 with a predetermined surface area for applying a sealant. The surface area on the lid 46 enables the application of an appropriate amount of sealant to ensure that the return mailer is sealed from the recipient location to the subsequent destination. For example, the length of edges 47 and 48 is one half of an inch.

Between the first and second side edges 47 and 48 of the lid 46 is a top edge 49 of the lid 46. The top edge 49 is linear, perpendicular to the first and second edges 47 and 48, and parallel to the top edge 45 of the rear leaf 42 of the pocket 36. The length and shape of the top edge 49 is the same as the top edge 45 to provide the lid 46 with a rectangular surface area.

The sealant applied to the lid 46 is the kind that can be activated with the addition of a liquid, such as by saliva from a person spending the return mailer to the original sender. Such a sealant is known as a remoistenable sealant because it is applied to the lid 46 of the return mailer 35 prior to reaching the recipient, allowed to dry, and allowed to be wetted by the recipient for sealing against the front leaf 37 of the pocket 36.

Extending above the pocket 36, above the lid 46 of the rear leaf 42, is a tear off section 49*b*. The tear off section 49*b* connects the return mailer 35 to the tear off sections 21 and 28*b* of inner leaf 7 and rear leaf 25 of the mailer 1 during transit, prior to reaching the recipient. The tear off section 49*b* is removed from the mailer by the recipient simultaneously with the tear off sections 21 and 28*b* of the inner leaf 7 and the rear leaf 25, releasing the return mailer 35 from the mailer 1.

The tear off section 49*b* has a perforated bottom edge which is the top edge of the lid 49. The perforated edge 49 is capable of being torn from the return mailer 35 by a simple twisting of the tear off section 49*b* from the rear leaf 42 of the return mailer 35 about the perforated edge 49.

In use, the return mailer 35 is sealed to the tear off section 28*b* of the rear leaf 25, between the rear leaf 25 and the inner leaf 7. When the return mailer 35 is sealed in the mailer 1, the perforated edge 49 is parallel to and coincident with the perforated edge 28 on the rear leaf 25 of the mailer 1 (FIG. 3). This orientation places the perforated edge 17*b* on the inner leaf 7 in a configuration that is parallel to and coincident with the perforated edges 49 and 28 of the return mailer 35 and rear leaf 25.

The tear off section 48 has top edge 50. The top edge is parallel to the perforated edge 49. The distance between the top edge 50 and the bottom edge 49 creates a surface area for applying the sealant that connects the tear off section 49*b* of the return mailer 35 to the tear off section is large enough to ensure that the return mailer 1 remains connected to the mailer 1 while the mailer 1 is being transported to the recipient. As an example, the top edge is offset from the bottom edge by one half of an inch. This offset distance places the top edge 50 of the tear off section 49*b* of the return mailer 35 against the top edge 28*e* of the tear off section 28*b* the rear leaf 25.

In use, when a recipient of the mailer 1 tears the opening lid 29 (FIG. 3) off of the rear leaf 25 of the mailer 1, the tear off section 49*b* of the return mailer 35 is simultaneously removed from both the return mailer 35 and the mailer 1 along with the lid 29. Subsequent to this action, the return mailer 35 is freed from the mailer 1 and is capable of receiving an invoice or buck slip, of being sealed and being mailed to the address on the invoice or buck slip.

Turning back to FIG. 2, a series of buck slips 51 are illustrated. The buck slips are leafs of paper typically used for displaying advertisements, coupons, incentives, warnings, or other types of information which is intended to be read and used by the recipient. For example, the buck slips 51 could contain a rebate for product, where the customer can return the rebate along with the invoice in the return mailer. On the other hand, the rebate might have instructions for how the customer is to proceed. For example, the rebate could state that the customer should call a toll free number to engage in a contract for a product or service.

The buck slips 51 are made of paper having a weight that enables the paper to withstand commonly applied stress during the processing and mailing of the mailer 1. The weight of the buck slips also allows the mailer 1 to maintain a first class mail rating when the mailer is filled with a return mailer and a plurality of buck slips.

The buck slip 51 include a first leaf 52. The first leaf 52 shares the bottom edge of the inner leaf 11. The first leaf 52 is continuous with the inner leaf 11 and permanently attached to the inner leaf. Advertisements placed on the first leaf 11 are removed from the mailer by cutting the first leaf from the 52 mailer with scissors or tearing the leaf 52 from the mailer 52.

The first leaf 52 has a first and second side edges 53 and 54. The first edge 53 extends from the first edge of the inner leaf 14 and the second edge 54 extends from the second edge of the inner leaf 15. The first and second edges 53 and 54 are parallel to each other and perpendicular to the bottom edge 11. The distance that the edges 53 and 54 extends is less than the distance between the bottom of the rear leaf 3 and the top of the rear leaf 28. The limitation on the distance prevents crumpling of the first leaf 52 when the mailer 1 is closed. For example, the edges 53 and 54 extends three and a half inches, or half an inch short of the distance between the bottom edge of the rear leaf 3 and the top edge of the rear leaf 28.

The first leaf of the buck slip 52 has a top edge 55. The top edge 55 is parallel to the bottom edge 11 of the first leaf and perpendicular to the side edges 14 and 15 of the first leaf. The top edge 55 completes the surface of the first leaf 52, defining a rectangular buck slip. The surface area of the buck slip 52 is smaller than the surface area of the rear leaf 25 so that the edges of the buck slip 52 fit within the mailer without being crumpled.

The buck slips 51 include a second buck slip 56. The second buck slip 56 is fabricated from a material that is light enough to cause the mailer 1 to maintain a first class mail rate when in transit to the recipient. The material is strong enough to withstand the shearing and compressive stresses placed upon the mailer 1 in transit.

The second buck slip 56 has a top segment 57. The top segment has a bottom edge 58. The bottom edge 58 is the same length as the bottom edge of the first buck slip 11. When placed in the mailer 1, the bottom edge of the 58 is coincident with the bottom edge of the first buck slip 11 and connected to the mailer 1 with, for example, staples.

The top segment of the second buck slip 56 has first and second parallel edges 59 and 60. The edges 59 and 60 are parallel to each other and perpendicular to the bottom edge 58. When the top segment is placed in the mailer, edges 59 and 60 are parallel to the side edges of the inner leaf 26 and 27. The edges 59 and 60 fit within the mailer 1 so that the sides of the top segment 56 are free from crumpling during transit to the recipient.

The edges 59 and 60 have the same length and extend to a distance that is shorter than the distance between the bottom and top edges of the first buck slip 11 and 55. The limitation on the distance allows a user to see a top area of the first buck slip 11 upon opening the mailer 1. Accordingly, advertisements on the first buck slip will be noticed regardless of the information displayed on the top segment of the second buck slip 56. For example, the edges 59 and 60 extend three inches, or half of an inch shorter than the distance between the bottom and top edges of the first buck slip 11 and 55.

The top segment of the second buck slip 56 has a top edge 61. The top edge is parallel to the bottom edge 58 and perpendicular to the side edges 59 and 60. The top edge 61 completes the rectangular surface area of the top segment of the buck slip 56 and defines a surface area that is less than the surface areas of either the first buck slip 52 and the rear leaf 25. As with the first buck slip 52, the top segment of the second buck slip 56 will fit within the mailer without crumpling.

The second buck slip 56 has a bottom segment 62. The bottom edge of the bottom segment 62 is the bottom edge of the top segment 58. The bottom segment of the buck slip 62 is a continuous piece with the top segment of the buck slip 56. The top and bottom segments of the second buck slip 56 and 62 are capable of being used as a single bi-folded buck slip for the purpose of displaying one or more large advertisements. As a single buck slip, the buck slip is removable from the mailer 1 by pulling the buck slip away from the staples, outwardly from the center of the mailer.

As an alternative to using the second buck slip as a single buck slip, the top and bottom segments 58 and 62 are capable of being used as separate buck slips for displaying a plurality of advertisements. The smaller advertisements would be separable about the bottom edge of the second buck slip 58, or some other edge that is intermediate of the outer edges of the second buck slip 56.

The bottom segment of second buck slip 62 has first and second side edges 63 and 64. The first and second side edges extend from the first and second side edges of the top segment 59 and 60. When the buck slip 56 is placed within the mailer 1, the first and second side edges of the rear leaf 26 and 27, preventing the side edges 63 and 64 from crumpling in transit.

The first and second side edges of the bottom segment 63 and 64 extend by a distance that is shorter than the distance between the bottom and top edges of the top segment of the second buck slip 59 and 60. This limitation allows an area of the top segment of the buck slip 57 to be visible behind the bottom segment 62 when the mailer is opened. When the mailer is opened, any advertisements on the top segment of the second buck slip will be noticed by the recipient, ensuring their affectability. For example, the side edges extend by two and a half inches, or half an inch short of the distance between the bottom edge and the top edge of the top segment of that second buck slip 59 and 60.

The bottom segment 63 has a top edge 65. The top edge 65 is parallel to the bottom edge of the bottom segment 58 and perpendicular to the side edges of the bottom segment 59 and 60. The top edge 65 completes the surface area of the bottom segment of the second buck slip 62 and defines a rectangular surface. The surface area of the bottom segment of the second buck slip 62 is smaller than the surface area of the top segment of the second buck slip 57 and smaller than the surface area of the inner leaf 25, so that the bottom segment of the second buck slip 62 will be free form crumpling upon the closing of the mailer 1.

In use, the customer receives the mailer 1 and pulls the opening flap 29 (FIG. 3) from the mailer 1, without tearing the perforations, to expose the contents in the front pocket 17. The customer then tears off the opening flap 29, which simultaneously tears off the opening flap 29, which simultaneously tears off the tear off sections 21, 28*b*, and 49*b* of the inner leaf 7, the rear leaf 25, and the return mailer 35. This process separates from the mailer the top edge 17*b* of the inner leaf 7, the top edge 28 of the rear leaf 25, and the top edge 49 of the lid 35 of the return mailer 35. Once the tear off sections 21, 28*b*, and 49*b* are completely disengages from the remainder of the mailer 1, the front and rear leafs, 7 and 25, open about the bottom edge 3 of the leafs, the return mailer 35 is freed and ready to be used, and the buck slips 51 are freed and ready to be read and used.

Accordingly, a mailer has been disclosed for distributing advertisements and invoices. The mailer provides an envelope for returning the invoices and a buck slip for displaying advertisements and incentives. The return mailer is attached to the mailer and is removed from the mailer simultaneously upon the opening of the mailer.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within are to be embraced within their scope.

I claim:

1. A mailer comprising a front leaf, a rear leaf, and a return mailer:

a. each leaf comprising a tear off section; and b. the return mailer comprising a tear off section, wherein:

i. each tear off section is interconnected and removable simultaneously from the mailer for opening the mailer so that the return mailer is automatically detachable from the mailer upon opening of the mailer;

ii. the mailer comprises a leaf for displaying indicia, the leaf being securely connected to the mailer upon opening of the mailer, wherein the mailer comprises a top, a bottom, and first and second sides, and wherein the first and second sides are unsealed, wherein the mailer comprises an inner leaf, and wherein the front leaf is sealed to the inner leaf on three sides defining a pocket, wherein the leaf for indicia is a buck slip, and wherein the buck slip connects to the middle of the inner leaf.

2. The mailer of claim 1, wherein the buck slip is shorter than the rear leaf.

3. The mailer of claim 2, wherein the buck slip is a bi-fold buck slip comprising a front and rear leaf, the front leaf of the buck slip comprising a front and rear leaf, the front leaf of the buck slip being shorter than the rear leaf of the mailer and the rear leaf of the buck slip being shorter than the front leaf of the buck slip.

4. The mailer of claim 3, wherein the bi-fold buck slip remains attached to the mailer upon opening the mailer.

5. The mailer of claim 4, wherein the bi-fold buck slip is capable of being selectively removed from the mailer upon opening the mailer.

6. The mailer of claim 5, comprising a front flap that is capable of being removed from said mailer simultaneously with the tear off sections.

7. The mailer of claim 6, wherein the return mailer comprises a lid.

8. The mailer of claim 7, wherein the tear off sections are attached to the front and rear leaf and return mailer with perforations.

* * * * *